United States Patent [19]

Cooke et al.

[11] 3,991,578

[45] Nov. 16, 1976

[54] SELF-ADVANCING MINE ROOF SUPPORTS

[75] Inventors: John Cooke, Bolton; Derek Alker, Wigan, both of England

[73] Assignee: Gullick Dobson Limited, Wigan, England

[22] Filed: Mar. 21, 1975

[21] Appl. No.: 560,723

[30] Foreign Application Priority Data

Apr. 10, 1974 United Kingdom ..... 14807

[52] U.S. Cl. ..... 61/45 D; 91/1; 91/36; 91/412

[51] Int. Cl.[2] ..... E21D 15/44; F15B 21/02

[58] Field of Search ..... 61/45 D; 91/1, 36, 412

[56] References Cited

UNITED STATES PATENTS

| | | | |
|---|---|---|---|
| 3,228,199 | 1/1966 | Potts et al. | 61/45 D |
| 3,272,084 | 9/1966 | Bolton et al. | 61/45 D X |
| 3,285,015 | 11/1966 | Carnegie et al. | 61/45 D |
| 3,500,719 | 3/1970 | Rieschel | 91/36 |
| 3,601,998 | 8/1971 | Bower | 61/45 D |

*Primary Examiner*—Jacob Shapiro

*Attorney, Agent, or Firm*—Berman, Aisenberg & Platt

[57] ABSTRACT

A control means, for a mine roof support having hydraulically extensible prop means and some other pressure-fluid-operated component (e.g. a hydraulic ram for advancing the support), comprises a control valve having selectable positions in one of which (the prop extend position) it will select for a supply of hydraulic pressure-fluid to said prop means. The control means also include a valve device having a position in which it will provide for a supply of pressure-fluid to the prop means and having means adapted to cause it to move to that position, when the control valve is operated to the prop extend position, and to keep it in that position even when the control valve is operated from the prop extend positon. By this arrangement a pressure-fluid supply to the prop means will still be maintained so as to ensure proper setting thereof and to make up any leakage of fluid. The operation of the control valve from the prop extend position may be, for example, to bring it into a neutral position or to a position in which pressure-fluid is supplied to the advancing ram of the support.

In one preferred embodiment of the invention the valve device has a pressure-fluid responsive movable member and is adapted to be connected, for its operation, to a pressure-fluid supply via the control valve.

14 Claims, 7 Drawing Figures

—FIG.1—

—FIG. 2—

Figure 1:
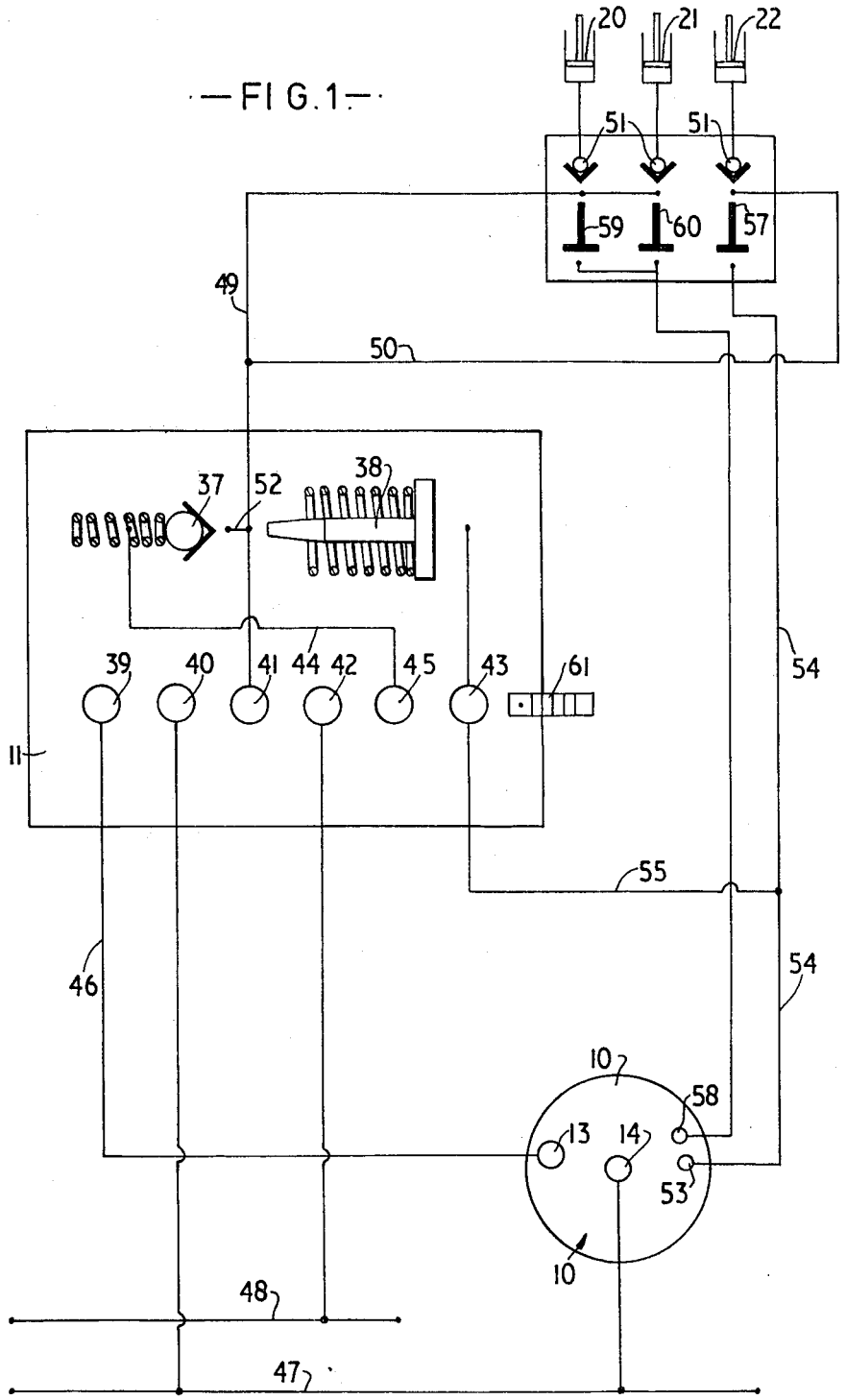

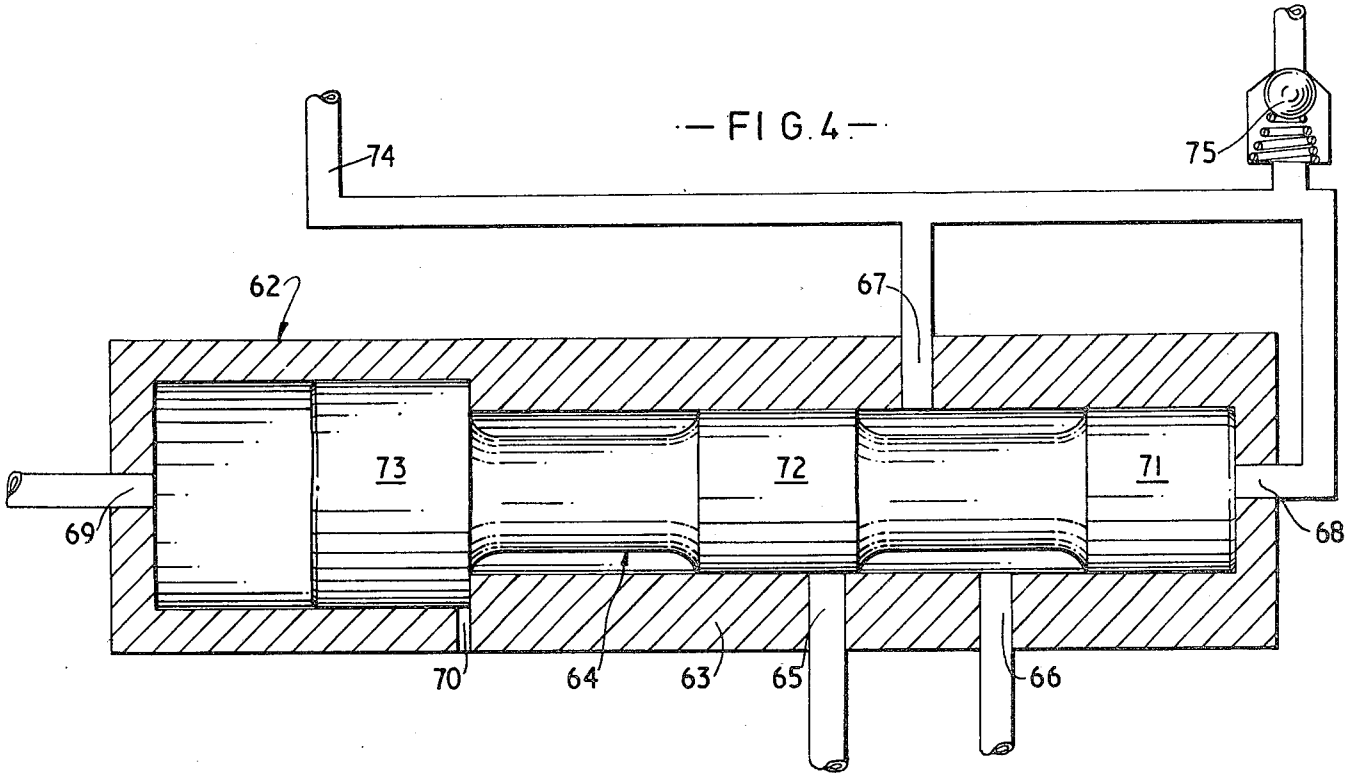
— FIG. 4 —

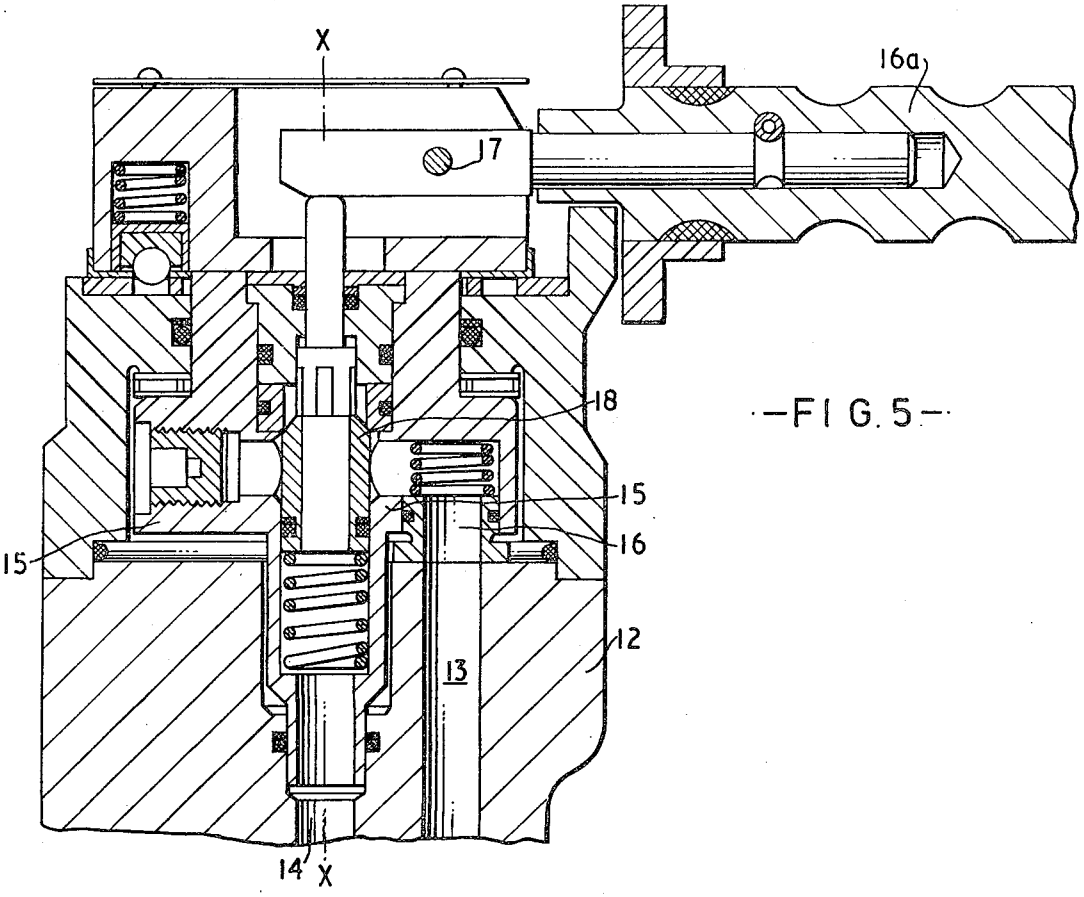
—FIG. 5—

—FIG. 6—
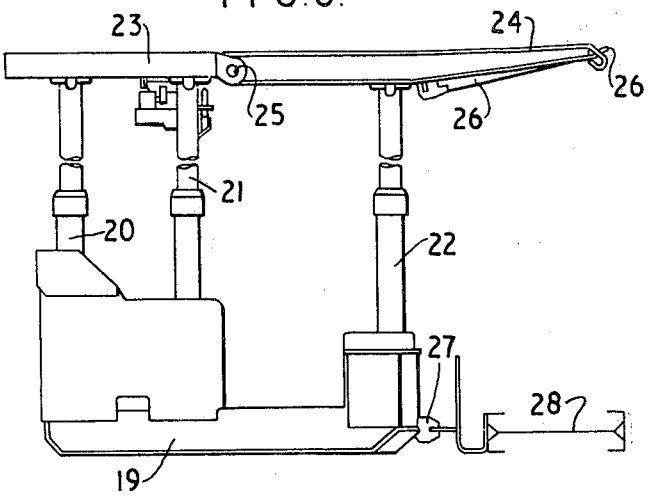
—FIG. 7—
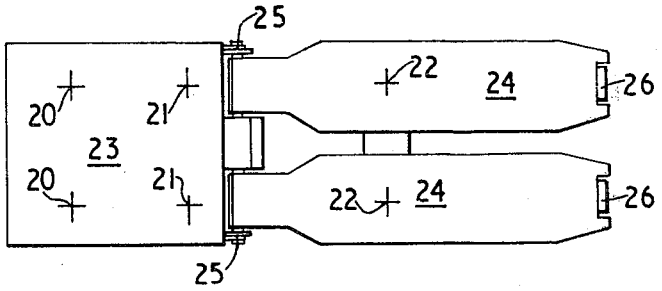

SELF-ADVANCING MINE ROOF SUPPORTS

This invention is for improvements in or relating to control means for a mine roof support and particularly but not essentially a self-advancing support of the kind (hereinafter referred to as the kind specified) comprising hydraulically extensible means (hereinafter referred to as prop means) for applying a roof-engaging member of the support to the mine roof and a pressure-fluid operated means (hereinafter referred to as a hydraulic advancing ram) for advancing the support as winning of mineral from a mineral face proceeds. The advancing ram may, for example, also serve to advance the face conveyor, the ram which is double-acting then using the conveyor as an anchorage to advance the support. Alternatively the support may comprise two units to which the cylinder and piston of the ram are connected respectively. In this case each unit in turn acts as an anchorage or abutment for the advance of the other when the latter has been temporarily released from between roof and floor of the mine working.

It is convenient to control the raising and lowering of the prop means and the operation of the advancing ram by a control valve having an operating member (e.g. a handle) which is moved to select one of a plurality of different positions according to the operation it is required should take place. Such an arrangement, as available heretofore, has the disadvantage that when the control valve is moved from the prop extend position, after the prop means has been set between floor and roof, the supply of pressure-fluid to the prop means is cut off. In such circumstances the prop means may not be fully set because pressure has not built up to the required figure when the operator moves the control valve because the prop means appears to him to be properly set. Furthermore after having been properly set the prop means may retract, due for example to leakage of hydraulic fluid, with a resultant loss of efficiency in the setting of the prop means.

According to the present invention there is provided control means for a mine roof support comprising a control valve having selectable positions in one of which (the prop extend position) it will select for a supply of pressure-fluid to hydraulically extensible prop means of the support, and a valve device having a position in which it will provide for a supply of pressure-fluid to said prop means of the support and having means adapted to cause it to move to that position, when the control valve is operated to the prop extend position, and to keep it in that position when the control valve is operated from the prop extend position, whereby a pressure-fluid supply to the prop means will be maintained.

According to a further feature of the present invention there is provided control means for a self-advancing mine roof support, of the kind specified, comprising a control valve having selectable positions in one of which (the prop extend position) it will select for a supply of pressure-fluid to the prop means of the support and in another of which it will select for the supply of pressure-fluid to some other hydraulic component of the support, and a valve device having a position in which it will provide for a supply of pressure-fluid to said prop means and having means adapted to cause it to move to that position, when the control valve is operated to the prop extend position, and to keep it in that position when the control valve is operated from the prop extend position to one other position, whereby a pressure-fluid supply to the prop means will be maintained. Said other position may be a neutral position in which the control valve is closed or a position in which pressure-fluid is supplied to said some other hydraulic component (e.g. the hydraulic advancing ram) of the support.

Conveniently the valve device is kept in said position by a hydraulic lock produced in the valve device when it is operated to that position to provide pressure-fluid to the prop means. The hydraulic lock may be maintained by a non-return valve and a pressure-fluid-operated striker provided, for opening said non-return valve, to break the hydraulic lock, said striker being connected to the control valve which is adapted to connect the striker, for its operation, to a pressure-fluid supply.

The control valve and the valve device of the control means may be arranged to provide for differential lowering of rearward and forward props of the prop means. For example, the arrangement may be such that front props are lowered before rear props.

Figure 2:
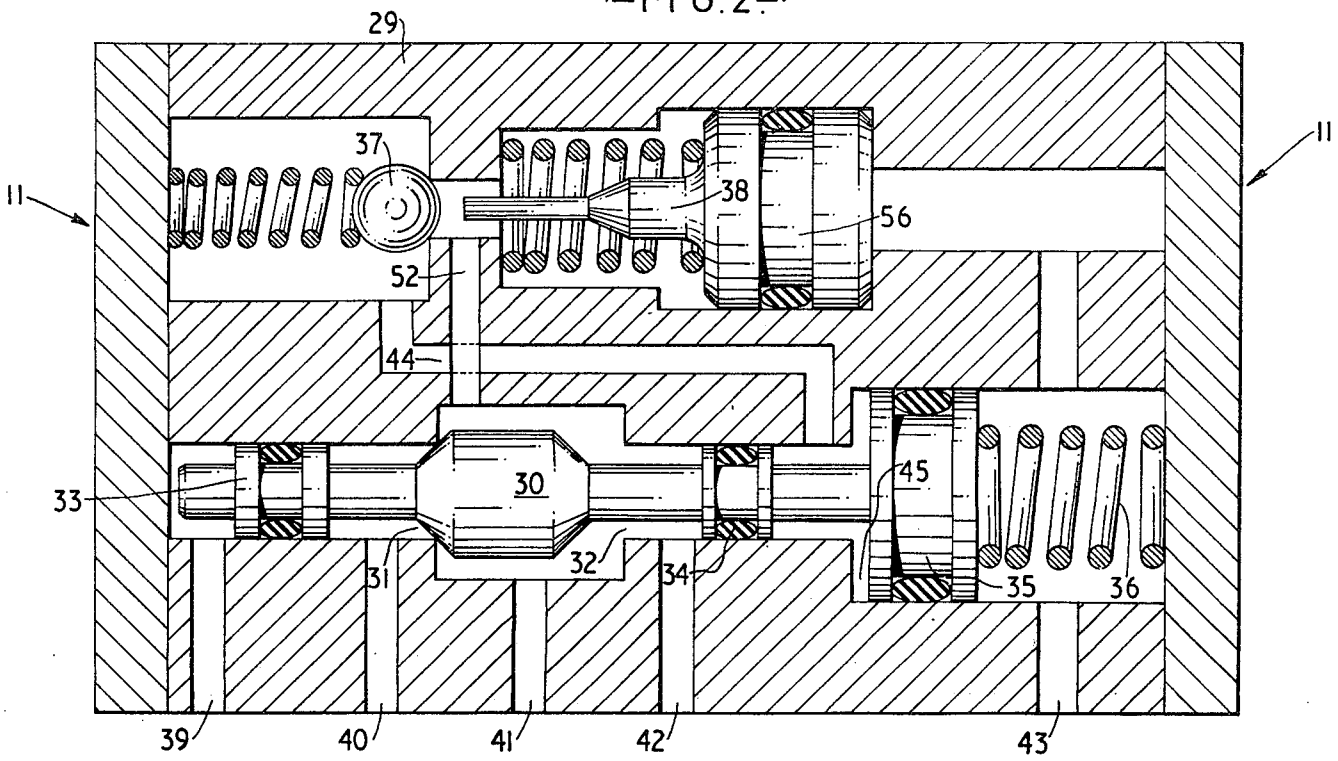
Figure 3:
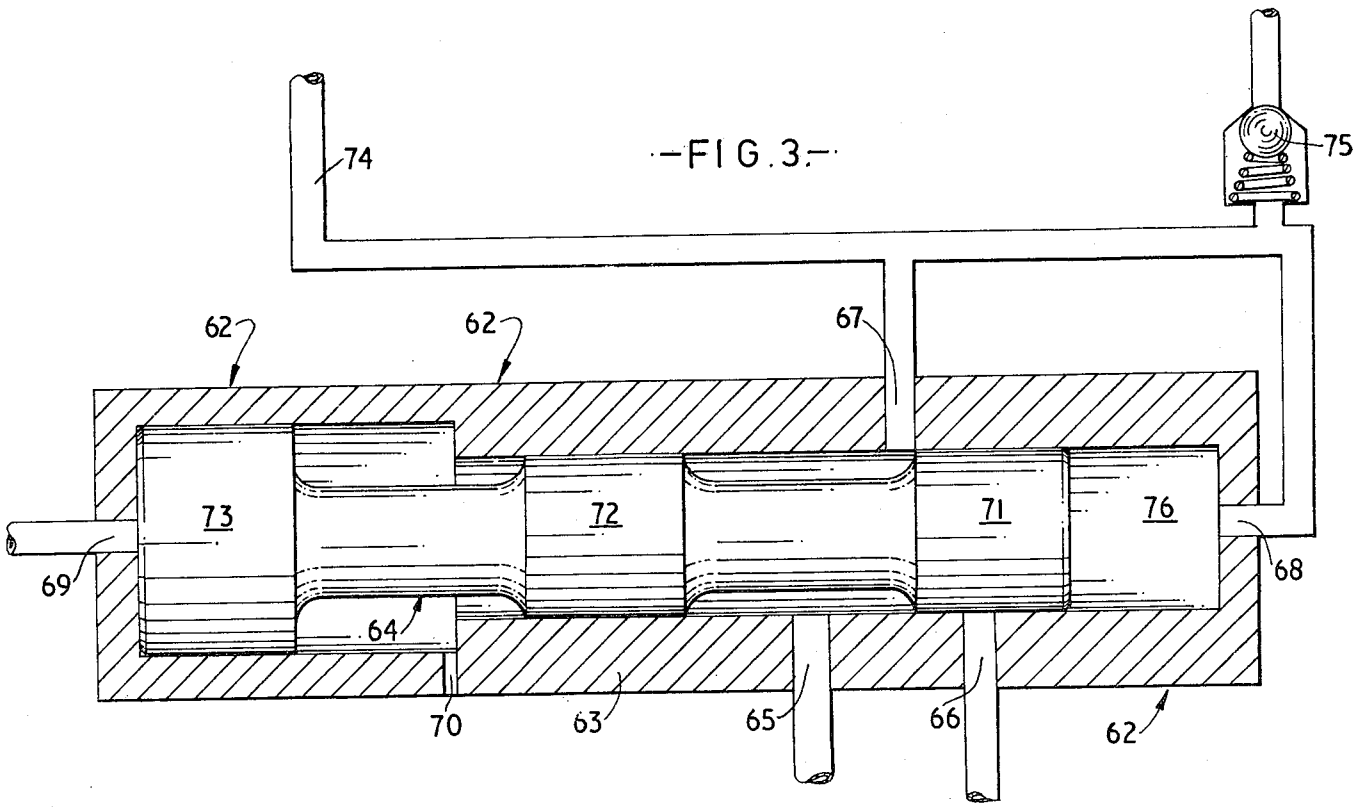

Two particular embodiments of the invention will now be described, by way of example, with reference to the accompanying drawings in which:

FIG. 1 is a diagram of one embodiment,

FIG. 2 is a sectional view of a valve unit incorporated in the embodiment of FIG. 1, FIGS. 3 and 4 are diagrammatic representations of the other embodiment, FIG. 5 is a sectional elevation of a pressure-fluid control and selector valve incorporated in the above-mentioned embodiments of the invention, FIG. 6 is a side elevation of a hydraulically operated self-advancing mine roof support to which the invention is applicable, and FIG. 7 is a plan view of the roof support shown in FIG. 6.

The embodiment of the invention shown in FIGS. 1 and 2 comprises a pressure-fluid control and selector valve 10 and a valve device 11.

The control valve 10 is of the character described in the specification of our United Kingdom Pat. Specification No. 1,261, 129 and is shown in some detail in FIG. 5. Briefly it comprises a body part 12 having a plurality of ports circumferentially spaced around it, one of said ports being shown at 13. The body part 10 is also provided with a centrally positioned pressure-fluid port 14. The movable member of the valve comprises a rotatable disc 15 having a port part 16 adapted to be brought selectively into register with said circumferentially spaced ports in the body part 10. Rotary movement of the disc 15, about the axis X—X, is effected by a handle 16*d*. The handle 16*a* is also adapted, by angular movement about a pivot 17, to open a spring-loaded valve 18 controlling the flow of pressure-fluid through the port 14. It will be understood that when the handle 16*a* is lifted to open the valve 18, and turned so as to bring the port 16 into register with one of the ports in the body part (e.g. the port 13) a fluid flow passage will be established between said port in the body part and the port 14. It will also be understood that the valve incorporates a "dead man's handle" feature in that if the handle 16*a* is accidentally released the spring-loaded valve 18 will close automatically and stop the flow of fluid through the valve.

The hydraulically operated self-advancing mine roof support, the operation of which is controlled by the valve 10 and valve unit 11, comprises (see more particularly FIGS. 6 and 7) a base 19 having mounted on it rear, middle and front hydraulically extensible telescopic props 20, 21 and 22 respectively. The props 20 and 21 support a roof-engaging canopy 23 and the props 22 support cantilever roof-engaging members 24 hingedly connected to said canopy at 25. The members 24 are provided with slidably extensible and retractible extension bars 26. A hydraulic ram is disposed horizontally in the base 19 and has its piston rod 27 connected to the mineral conveyor 28 which extends along the mineral face being worked. Following the removal of a web of mineral from said face the hydraulic ram is extended so as to advance the conveyor 28 in the known manner. The props are then temporarily lowered and the ram is retracted so as to advance the support. The props are then extended into a roof supporting condition. It will be understood that there will be a large number of roof supports, as just described, positioned in side-by-side relationship along the mineral face. A mining machine runs on the conveyor 28 and the mined mineral is delivered into said conveyor and conveyed to the gate or roadway of the mine working.

Referring now to the valve device 11, which is shown in detail in FIG. 2, this comprises a casing or chest 29 which houses a pressure responsive shuttle valve 30 which is movable between valve ports 31 and 32. The shuttle valve has pistons 33, 34 and 35 and is spring-loaded by a spring 36. The casing 29 also houses a spring-loaded non-return valve 37 having associated with it a spring-loaded pressure responsive striker 38. Ports 39, 40, 41, 42 and 43 are provided in the casing or valve chest 29. The casing also has an internal port or passageway 44 which is associated with a hydraulic-lock chamber 45. The port 39 (see FIG. 1) is connected by a pipe line 46 to the port 13 of the control valve 10. The port 40 is connected to a hydraulic pressure-fluid feed line 47 and the port 42 is connected to a pressure-fluid return or exhaust line 48. The function of the ports 41, 43 and 44 and the devices associated therewith will be understood from the following description of how the above-described control system operates.

When the control valve 10 is operated and the port 16 is brought into register with the port 13, pressure-fluid flows via the port 14 and via the ports 16 and 13, of the control valve 10, to the port 39 of the shuttle valve 11. Thus, the shuttle 30 will move, against the action of the spring 36, to open the port 31 and close the port 32. Pressure-fluid will then flow, from the feed line 47, via the ports 40 and 41, pipe lines 49 and 50 and non-return valves 51 to the props 20, 21 and 22. The props are thus extended and the support is set securely between floor and roof of the mine working.

For the purpose of the present invention pressure-fluid also flows via a passageway 52, the non-return valve 37 and the passageway 44 to fill the hydraulic-lock chamber 45. Thus, the shuttle 30 is held, against the action of the spring 36, in a position in which the ports 40 and 41 remain connected even although there may be a change in the position of the control valve 10 so that pressure is taken off the piston 33 of the shuttle valve. For instance, the control valve 10 may be turned to a neutral position and subsequently operated so as to connect, via ports in it (not shown), the pressure-fluid line 47 to the above-mentioned advancing ram of the support. Thus pressure is maintained on the props and any leakage therefrom is automatically made good.

When it is required to lower the roof support, prior to advancing it, the control valve 10 is turned, so as to bring the port 16 of it into register with a port 53 (see FIG. 1) of said valve, and is operated so that pressure-fluid flows from the port 14, via a pipe line 54, pipe line 55 and port 43 of the shuttle valve to the piston 56 of the pressure-responsive striker 38. The striker 38 then positively opens the non-return valve 37 and releases fluid from the hydraulic-lock chamber 45. The shuttle then moves, under the action of the spring 36, to close the port 31 and re-open the port 32 so as to connect the ports 41 and 42 as shown in FIG. 2. At the same time pressure-fluid flows, via the pipe line 54 to a pressure-responsive striker 57 which positively opens the non-return valve 51 of the front props 22 and the pressure-fluid is exhausted therefrom, via the pipe line 50 and ports 41 and 42, to the return line 48. Thus the front props are lowered.

To lower the rear and middle props 20 and 21 the control valve 10 is set in a position in which its port 16 registers with a port 58 of said valve. The control valve is then operated so that pressure-fluid via the port 14, of the control valve, acts on pressure responsive strikers 59 and 60 which positively open the non-return valves 51 associated with said props. Pressure-fluid is then exhausted from the props 20 and 21, via the pipe line 49 and the ports 41 and 42 of the shuttle valve, to the return line 48.

The control valve 10 may have a position in which the ports 53 and 58 are connected simultaneously to the port 14 so that all the props 20, 21 and 22 can lower at the same time.

When it is subsequently operated, to close the ports 53 and 58 and open the port 13, the control valve 10 passes through a position in which the ports in it allow pressure-fluid to exhaust from the pressure responsive strikers 38 and 57, 59 and 60.

A mechanically actuated device, indicated diagrammatically at 61 in FIG. 1, may be provided to indicate externally the position of the shuttle 30 of the shuttle valve unit 11.

The second embodiment of the invention will now be described. This embodiment is also applicable to a mine roof support substantially as previously described with reference to FIGS. 6 and 7 and also includes a manually operable selector and control valve as described with reference to FIG. 5. It also incorporates a shuttle valve device 62 which is shown in detail in FIGS. 3 and 4.

The shuttle valve device 62 comprises a casing or valve chest 63 in which there is slidably housed a shuttle 64. The casing 63 has ports 65, 66, 67, 68 and 69 and a vent 70 and houses piston members 71, 72 and 73 of the shuttle 64, the piston member 73 being larger than the piston members 71 and 72.

The port 65 is connected to a pressure-fluid feed line and the port 66 is connected to a pressure-fluid return line. The port 67 is connected via a pipe line 74 directly (i.e. without non-return valves as shown in FIG. 1) to the hydraulic props 20, 21 and 22 of the roof support. The port 68 is adapted to be connected via a non-return valve 75 and a port (e.g. the port 13) in the body 12 of the control valve 10, to the pressure-fluid supply. The port 69 is also adapted to be connected, via another of the ports in the body 12 of the control valve 10, to the pressure-fluid supply line. The port 67 is connected to the pipe line 74 and thereby to the props 20, 21 and 22, and also to the port 68.

When the control valve 10 is in a position (the prop raise position) to supply pressure-fluid, via the non-return valve 75, to the port 68, of the shuttle valve, the shuttle 64 occupies the position shown in FIG. 3 and the props 20, 21, 22 are under pressure by fluid supplied to them via the ports 65 and 67 and the pipe line 74. The shuttle 64 is positively held in this position, despite any change in the setting of the control valve 10, by fluid trapped in the chamber 76 of the shuttle valve and acting on the piston 71 of the shuttle. Furthermore any leakage from the hydraulic props will be made up automatically by pressure-fluid supplied via the ports 65 and 67.

To lower the hydraulic props of the support the control valve 10 is turned, to bring the appropriate ports into register, and operated so that pressure-fluid is applied, via the port 69 to the large piston member 73 of the shuttle. The shuttle then moves into the position shown in FIG. 4 so as to close the port 65 and open the port 66 to the port 67 so as to connect the pipe line 74 and thereby the props to the return or exhaust line.

The control means according to the invention may be arranged to control a group of roof supports, instead of a single support, and the control valve 10 for controlling one roof support may be mounted on an adjacent support.

We claim:

1. Control means for a mine roof support comprising a control valve having selectable positions including a prop extend position in which a supply of pressure-fluid is selected to operate extensible prop means of the support and a prop release position in which the extended prop means are selected for release, and a valve device intercoupled with the control valve by pressure-fluid lines and including means movable to a first position in response to selection of said prop extend position by said control valve and, when in said first position, for providing a supply of pressure-fluid to said prop means of the support, said valve device also including pressure-fluid connection means connected to the pressure-fluid supply of said prop means for keeping said valve device in said first position when the control valve is moved from said prop extend position for maintaining pressure-fluid supply to said prop means until said control valve is moved to said prop release position to release said pressure-fluid connection means for permitting said valve device to move to a second position for release of said prop means.

2. Control means as claimed in claim 1, wherein said control valve includes a selectable position corresponding to supply of pressure-fluid to some other hydraulic component of the support during selection of which said valve device remains in said first position.

3. Control means as claimed in claim 1, wherein said control valve includes a neutral position during selection of which said valve device remains in said first position.

4. Control means as claimed in claim 1 wherein the valve device has a pressure-fluid responsive movable member and is adapted to be connected, for its operation, to a pressure-fluid supply via the control valve.

5. Control means as claimed in claim 1 wherein the valve device is kept in said prop extend position by a hydraulic-lock produced in the valve device when it is operated to that position to provide pressure-fluid to the prop means.

6. Control means as claimed in claim 5 wherein said hydraulic-lock is maintained by a non-return valve and a pressure responsive striker is provided for opening said non-return valve, said pressure responsive striker being connected to the control valve which is adapted to connect the striker, for its operation, to a pressure-fluid supply.

7. Control means as claimed in claim 1 wherein the valve device comprises a shuttle valve.

8. Control means as claimed in claim 1 wherein the valve device comprises a spring-loaded shuttle valve.

9. Control means as claimed in claim 1 wherein the control valve and the valve device are adapted to provide for differential lowering of rearward and forward props of the prop means.

10. Control means as claimed in claim 1 wherein an indicator is provided for indicating externally the position of a movable member of the valve device.

11. Control means as claimed in claim 1 and further comprising non-return valve means through which the prop means is supplied with pressure-fluid, and pressure-fluid responsive striker means, under the control of the control valve, for opening said non-return valve means to release pressure-fluid from the prop means.

12. Control means as claimed in claim 1 wherein the valve device is kept in said position by a hydraulic lock produced in the valve device when it is operated to said prop extend position to provide pressure fluid to the prop means, said hydraulic lock being maintained by a nonreturn valve, a pressure responsive striker being provided for opening said non-return valve, said striker being connected to the control valve which connects the striker, for its operation, to a pressure fluid supply, the control means further comprising non-return valve means through which the prop means is supplied with pressure fluid, and pressure-fluid responsive striker means, under the control of the control valve, for opening said non-return valve means to release pressure fluid from the prop means, the striker for opening the non-return valve of the hydraulic-lock operating in unison with the striker means for opening the nonreturn valve means through which the prop means is supplied with pressure-fluid.

13. Control means as claimed in claim 1 in combination with a mine roof support and connected to hydraulically extensible prop means of said support for controlling the operation thereof.

14. Control means as claimed in claim 1 in combination with a self-advancing mine roof support and connected to hydraulically extensible prop means and other hydraulically operated means of the support, for controlling the operation thereof.

* * * * *